United States Patent [19]

Hegberg

[11] 4,398,663

[45] Aug. 16, 1983

[54] HEATING SYSTEM WITH STEAM RADIATORS

[75] Inventor: Richard A. Hegberg, Chicago, Ill.

[73] Assignee: Tour & Andersson Aktiebolag, Stockholm, Sweden

[21] Appl. No.: 270,874

[22] Filed: Jun. 5, 1981

[51] Int. Cl.[3] ..... F28D 1/00

[52] U.S. Cl. ..... 237/9 R; 237/67; 237/73; 236/92 R; 236/37

[58] Field of Search ..... 237/9 R, 67, 73; 236/37, 92 R

[56] References Cited

U.S. PATENT DOCUMENTS

| | | | |
|---|---|---|---|
| 2,030,542 | 2/1936 | Ross | 237/9 R |
| 2,868,461 | 1/1959 | Gaddis | 237/9 R |
| 3,059,854 | 10/1962 | Fehlinger | 237/9 R |
| 4,079,887 | 3/1978 | Paul | 237/9 R |

*Primary Examiner*—William R. Cline

*Assistant Examiner*—John F. McNally

*Attorney, Agent, or Firm*—Larson and Taylor

[57] ABSTRACT

A building heating system with a plurality of steam radiators is provided with a control unit for the steam boiler. The control unit receives signals representative of the outside temperature and the pressure of the steam in the feeder conduit. The control unit shuts off the boiler when the steam pressure in the feeder conduit exceeds a predetermined value corresponding to a given measured outside temperature. After the pressure has decreased to a value below the predetermined value for the measured temperature, the control unit restarts the boiler. Another control unit receives signals representative of the condensate temperature and the pressure in the return conduit. This control unit operates a vacuum pump in the return line and assures that the vacuum pressure in the return line is less than that which causes the condensate to vaporize.

7 Claims, 4 Drawing Figures

HEATING SYSTEM WITH STEAM RADIATORS

FIELD OF THE INVENTION

The present invention relates to a heating system having steam heating radiators in which the operation of the heating system is controlled in part by the steam pressure and outside temperature which are used to determine the need for heat to the radiators and in part by the condensate temperature and pressure in the return line which are used to control the operation of the vacuum pump.

BACKGROUND OF THE INVENTION

It is well known in the prior art that the automatic functioning of steam heated radiator plants can be used to provide a given comfortable temperature in the space to be heated by the radiators, such as the interior of an apartment of the like. It is also known that the automatic operation of the radiators should not only be dependent upon the interior temperature of the space to be heated but also depend upon outside climatic conditions.

The control of the heat radiators on the basis of the existing room temperature can take place individually for each radiator or in common for a group of such heat radiators by a thermostatically controlled valve which senses the inside temperature. However, it has been shown that there is a tendency for the inside temperature to change depending upon the outside climatic conditions. Thus, for instance, if the outside temperatures should suddenly get very low, the temperature inside of the area to be heated will have a tendency to be reduced rather quickly. When this condition occurs, it would be advantageous to be aware of the condition and to compensate for it. A prior art system which does this is manufactured by Dunham-Bush, Inc. of Marshalltown, Iowa and is called "Vari-Vac." With this system, stream is continuously supplied to the radiators but at a temperature and pressure which varies automatically with outside temperature and inside heat losses.

The outside conditions which have an influence on the rate at which the room temperature changes are the outside temperature, the degree of moisture in the outside air, sunshine, wind, rain, and snow. However, it should also be recognized that other climatic conditions may have a similar influence. Many systems have already been disclosed in which control units derive information relating to one or more of the above-mentioned conditions so that the control units of the heating system can be compensated for. Considering the fact that the outside temperature has a greater influence than any one of the other above-mentioned conditions, in this field of art it has become commonplace to represent one or more or all of the conditions with a measurement of the outside temperature, and this outside temperature will also be made use of in the present specification. However, the present invention should not be regarded as limited to the use only of the outside temperature for predicting changes in the inside temperature as mentioned above. Thus, even though the following specification uses the outside temperature as a demonstrative representation of any deliberate combination of indicators of the outside climatic conditions, the invention should not be regarded as limited to the use of the outside temperature only.

SUMMARY OF THE INVENTION

While the present invention may be used even if there are no individual control means for the heat given off from each separate heat radiator, it is believed that the temperature of the air in the control spaces will approach a comfortable value sooner and keep this value more constant if such individual controls of the amount of heat given off by each radiator are used. The usual way of controlling the heat transmission from the radiators is by means of thermostatically operated valves. In a heating system using steam fed radiators, the thermostatically operated valve should preferably be mounted in the inlet conduit of the radiators in which the condensed water moves.

The present invention, however, does not relate to this type of individual control. Instead, the present invention relates to the introduction of a control factor, dependent upon the outside climatic conditions, which affects the steam generator. The present invention will be described below in connection with a system in which the outside climatic condition is for illustration purposes shown to be the outside temperature.

In systems of the type to which the present invention relates, a system of steam fed heat radiators are connected to a control arrangement which determines the feed of stream to the radiators dependent upon the outside climatic conditions. However, a problem with the control arrangement of this type is to provide this control in an economical and effective way in order to avoid disturbing influences.

In the arrangement according to the present invention, a steam boiler is connected to a system of steam heating radiators by a feeder line and a return line. The feeder line feeds steam from the boiler to the radiators, and once the steam is condensed, the return line returns this condensed water back to the boiler. As the steam condenses in the radiators, heat is given off to the radiators and hence to the room to be heated. A vacuum pump is also provided in the return line for maintaining the circulation of the heat transfer medium.

One type of steam heating radiator system is known as a "two-pipe system." In the two-pipe system, steam is fed to the radiators by a first pipe or tube and the condensed water is removed from the radiators by a second pipe or tube. However, systems are also known in which the radiators are connected to the boiler by means of only one pipe or tube. In this type of system, the steam rises through the center of the tube to the radiator and the condensed water is removed from the radiator back to the boiler along the interior walls of tube. In this one pipe system, a steam trap or separator must be provided in order to separate steam from water which enters the boiler. While the present invention may be used with both a two-tube system and a one-tube system, it will be described in connection with a two-tube system.

In the two-tube embodiment of the invention, a boiler is connected to a system of steam heating radiators by a feeder line for steam and by a return line for the condensed water created in the radiators. In the return line, a vacuum pump is provided to ensure a reliable circulation of the condensed water so that the required quantity of condensed water is returned to the boiler. In addition, the vacuum pump also creates a vacuum in the system to reduce the steam temperature and hence the heating surface temperature of the radiator and the energy used.

In the feeder conduit, there is a pressure which will differ from the outside atmospheric pressure. This pressure is measured by a suitable instrument and an indication of this pressure is fed to a control unit. The control unit also receives an indication of the outside atmospheric condition which, as stated above, in the preferred embodiment is represented by the temperature of the outside atmosphere. In the control unit, an automatic control is created which is guided by the two signals so that the operation of the boiler is interrupted or started dependent upon the outside climatic conditions as well as the pressure in the feeder conduits. A function is thus built up from these two signals as will be explained later.

When the operation of the boiler has been shut off due to the control unit, it is possible that the vacuum pump in the return conduit could create such a low pressure that the water therein would boil. As the pump is intended for pumping water, it would no longer operate. The circulation of the heating medium in the plant would also be adversely effected as steam might enter the boiler by the return conduit, through which water normally is fed to the boiler and this may cause so called "water blows."

In order to prevent the system described above from being subjected to disturbances such as a water blow, and to reduce the heating surface temperature of the radiator and to reduce the energy used, according to a further embodiment of the present invention, it has been found advantageous to provide an additional control unit in the return conduit similar to the control unit described above in the feeder conduit. The control unit in the return conduit receives signals indicative of the vacuum in the return conduit and the temperature of the fluid in the return conduit. When these signals indicate that there is a risk of a condition in which steam may be created or fed into the return conduit, the control unit acts to shut the pump off. Otherwise, the control unit maintains the vacuum in the return line in a range slightly below saturation of the fluid therein.

The present invention will be further described below in connection with one embodiment shown in the attached drawings, but it is understood that the invention is not limited to this specific embodiment and that various modifications may occur within the scope of the invention.

DETAILED DESCRIPTION OF THE PREFERRED EMBODIMENT

Figure 1:
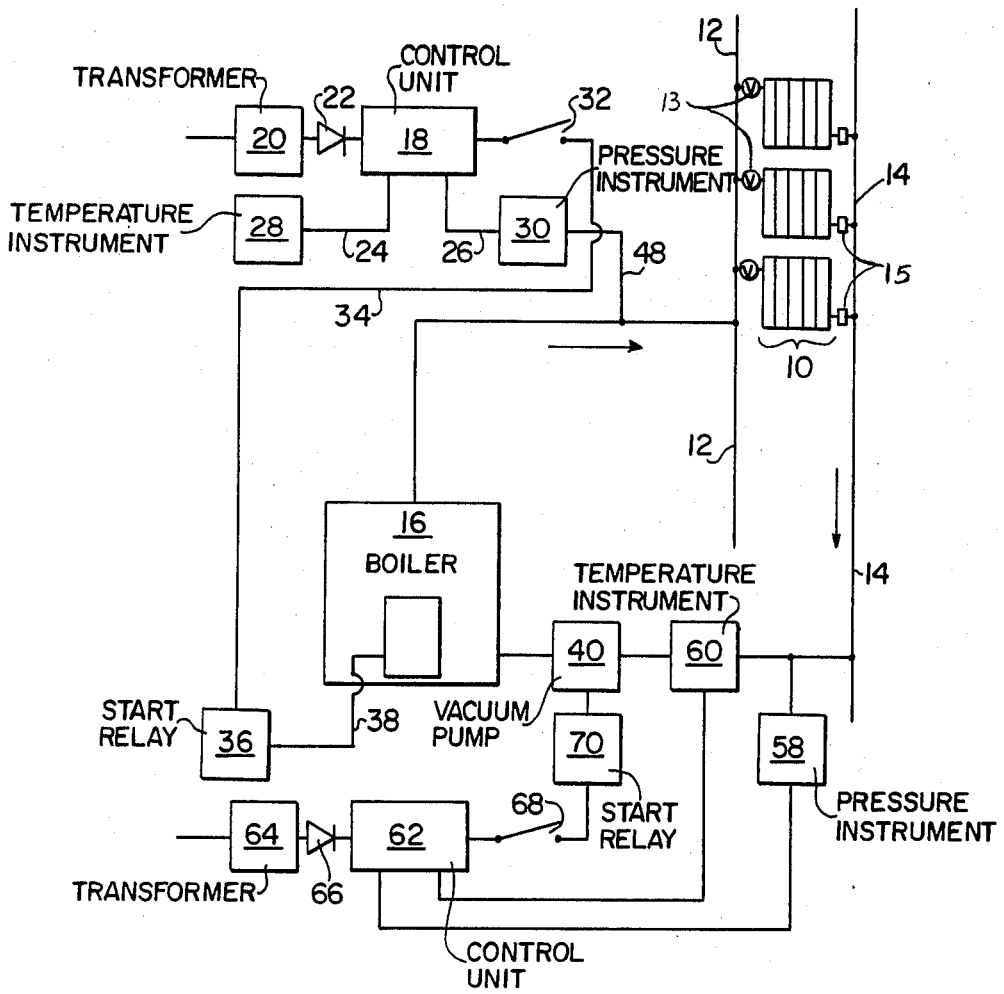
FIG. 1 is a schematic diagram of a heating system with two control units according to the present invention.

In the system depicted in FIG. 1, one or more spaces are heated by means of radiators 10. Radiators 10 are connected between a feeder conduit 12 and a return conduit 14. Feeder conduit 12 runs from a conventional steam boiler 16 to the radiators and return conduit 14 conducts the condensed water created in the radiators back to boiler 16.

A control unit 18, connected to feeder conduit 12, is fed wwith the necessary working voltage from a transformer 20. The input to transformer 20 is connected to a suitable source of electrical energy while the output of transformer 20 is connected to control unit 18, preferably but not necessarily, over a rectifier 22. Control unit 18 has two inputs 24 and 26. Input 24 is the carrier of a signal indicative of the outside climatic condition, which in this embodiment is the temperature of the outside air. The temperature of the outside air is measured by means of an instrument 28. Input 26 comes from an instrument 30 and carries a signal indicative of the steam pressure in feeder conduit 12.

In the preferred embodiment of the present invention, temperature measuring instrument 28 is a temperature sensitive resistor or thermistor. In this connection, it should be realized that the term thermistor has several different meanings. In this application, however, thermistor shall mean any deliberate electric component which is capable of creating a voltage, a voltage drop, a current, or a resistance which varies in a predetermined manner with the surrounding temperature such that the temperature may be read by measuring the voltage, voltage drop, current, or resistance. Input 26 receives a signal derived from a measurement instrument 30 indicating the steam pressure in feeder conduit 12. Thus, in the preferred embodiment, the temperature measurement instrument 28 can be a temperature sensitive resistor and the pressure measurement instrument 30 can be a potentiometer which is controlled in a completely mechanical way by bellows or the like with a resilient bias which is connected to the feeder conduit 12. The thermistor 28 and/or the bellows controlled potentiometer 30 may then be contained in a Wheatstone bridge, the output voltage of which is fed over an amplifier to a relay with a switch or switch contact influencing the operation of boiler 16. Such a contact is shown in FIG. 1 at 32.

Contact 32, over a conduit 34, influences the start relay 36 of boiler 16. As is readily apparent to one of ordinary skill in the art, the excitation or deexcitation of start relay 36 determines whether boiler 16 operates or not. In order to insure the circulation of fluid to the boiler, a vacuum pump 40 in return conduit 14 is provided. Vacuum pump 40 causes a vacuum to exist in return conduit 14 so long as pump 40 is operating. While the system described above is operable, the operation of the system will be much more reliable if the elements shown at the bottom of FIG. 1 are also used. These elements will be described later.

With the elements described above, this system operates in the following manner. Steam is fed from boiler 16 through feeder conduit 12 through radiators 10. In radiators 10, the steam is successively condensed and forms condensed water which is collected in the lower part of each separate heat radiator. The collected water creates a hydrostatic pressure, however, this hydrostatic pressure is not as a rule sufficient to maintain the heat medium circulation. The water collected has a temperature of up to 100° C. but, as a rule, the water temperature will fall below this value under release of small quantities of heat. It should be appreciated, however, that the substantial heat created by the radiators does not emanate from the temperature heat of the water but from the amount of heat which is released by the condensation of the steam.

Each individual heat radiator 10 may be provided with a control means for controlling the delivery of heat, for instance with a control valve in the oultet from the radiators for the condensed water, or with a control valve 13 in the inlet to the radiators as shown in FIG. 1. These control valves may be manually or automatically operated so that a temperature in the room is produced which is close to or equal to the comfortable temperature desired. Also shown in FIG. 1 is a steam trap 15 in the outlet of radiators 10.

Any control taking place at the heat radiators is guided by the temperature in the space to be heated. This temperature has a tendency to change due to heat being given off to adjacent spaces, especially the outside atmosphere. Thus, it is obvious that the temperature of the outside air determines the scope of the tendency of the inside temperature change, or in other words, the speed by which the temperature in the heated space drops under loss of heat to the outside air, if no steps are taken to compensate for this loss. This is the reason that the steam pressure in feeder conduit 12 is preferably provided as a function of the outside air temperature in the manner which will be evident from the explanations below. This provision of the steam pressure takes place intermittently by starting and stopping the operation of boiler 16. It is assumed that the water existing in boiler 16 has such a great heat capacity that the intermittent control of boiler 16 will not cause any essential fluctuations in the temperature of the steam in feeder conduit 12 and this temperature, therefore, may be approximately regarded as being continuously controlled.

Control unit 18 receives a signal indicative of the outside temperature over a conductor 24 from a temperature measuring element 28. In addition, control unit 18 also receives a signal indicative of the pressure in feeder conduit 12 over conductor 26 from a pressure measuring element 30.

Figure 3:
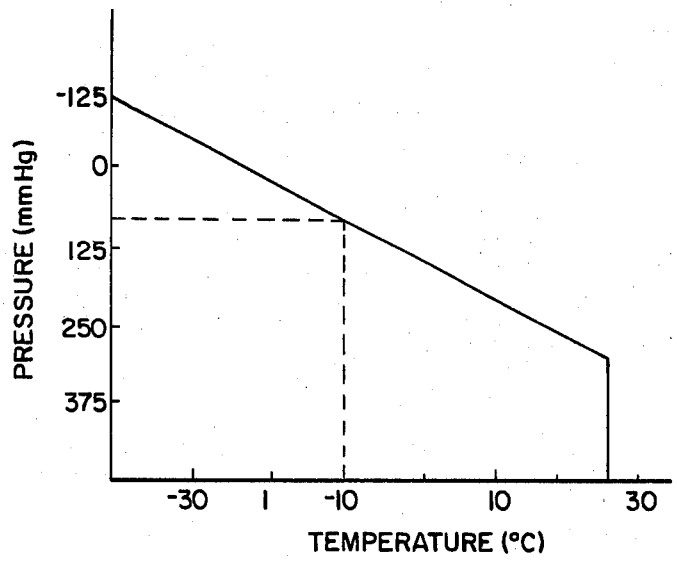
FIG. 3 is a temperature-pressure graph depicting the operation of the control unit in the feeder conduit.

FIG. 3 depicts the general relationship which exists between the outside temperature and the steam pressure for a particular space to be heated. The curve shown in FIG. 3 is, of course, individual to the specific room to be heated in which the system operates. This curve would have other values for other systems. Nevertheless, the curve will follow the same general slope as seen in FIG. 3.

In FIG. 3, the steam vacuum pressure as measured by means of element 30 is plotted in mm Hg along the vertical axis and the outside temperature measured by element 28 is plotted in degrees Centigrade along the horizontal axis. In order to make reading of FIG. 3 easier, the vertical axis has been provided with markings running from the upper end downwardly instead of, as is otherwise usual, from below upwardly. With reference to FIG. 3, it can be seen that at an outside temperature of −10° C., the steam vacuum pressure in feeder conduit 12 should be about 70 mm of mercury. It should also be noted that the steam pressure in feeder conduit 12 should be greater as the temperature of the outside air decreases. The sloping curve depicted in FIG. 3 thus represents an economical and functionally suitable relationship between steam pressure and outside temperature.

Control unit 18 is arranged so that it stops the operation of boiler 16 by means of a start relay 36 of the boiler as soon as the steam pressure in feeder conduit 12 rises above the value of the steam pressure shown in FIG. 3 which corresponds to the outside temperature or where an upper limit outside temperature is exceeded (approximately 25° C. in FIG. 3). With boiler 16 stopped, the steam pressure in feeder circuit 12 thereafter successively decreases. After a given control margin, which may for instance be 2 mm of mercury, boiler 16 is started again by means of starter relay 36.

Figure 2:
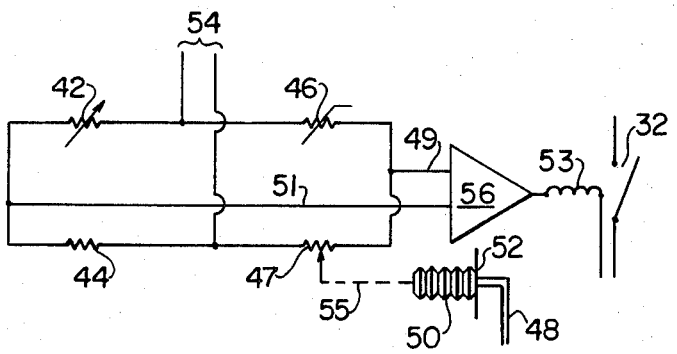
FIG. 2 is a schematic wiring diagram for the control unit depicted in FIG. 1.

A very simple, but nevertheless completely useful arrangement of control unit 18 is depicted in FIG. 2. Control unit 18 comprises a Wheatstone bridge having four resistors 42, 44, 46, and 47. Two of these resistors, resistors 42 and 44, remain constant during normal operation although one of them, resistor 42 may be manually adjustable for adapting the bridge to specific circumstances and conditions. Resistor 46 is a thermistor in the sense mentioned above, and thus, in its simplest form may be a heat sensitive resistor of any known type. Resistor 46 is in contact with the outside air and senses the temperature thereof. Resistor 46 therefore represents the measuring component 28 depicted in FIG. 1. Resistor 47 is variable dependent upon the steam pressure. This dependency is determined by the steam pressure being fed over a conduit 48 to a bellows 50. Bellows 50 is clamped between a fixed support 52 and means for mechanically transferring power to the moveable contact 55 of resistor 47 which is made in the form of a rheostat. The bridge is fed with a preferably unidirectional voltage over conduits 54 and the output diagonal voltage is fed over conductors 49 and 51 through amplifier 56 to relay 53. Relay 53 has as its contact the switch 32.

In many applications, the above described simplified arrangement will function with complete satisfaction. However, in some applications it is possible that at a high outside temperature with a corresponding high steam pressure in radiators 10 and feed conduit 12, a low rate of condensation will take place in heat radiators 10 so that steam will enter return conduit 14. The chances of this occurring are even greater if pump 40 is working with a high intensity so that a strong vacuum is created in return conduit 14. As mentioned above, pump 40 is not adapted for pumping steam and is harmed thereby. In addition, even if pump 40 were adapted to pump steam, this would be harmful to boiler 16. Boiler 16 is designed to contain water in the lower part and steam in the upper part. Where steam is pumped into the water in the lower part, so called "water blows" are created. In addition, when steam is pumped into the boiler instead of water, the control function of pump 40 is lost. For all the foregoing reasons, it is important in an arrangement of the type described above, that some sort of safety device be provided to prevent pump 40 from operating under the unfavorable condition where the medium being pumped is steam or contains steam.

Besides preventing steam from entering return conduit 14, the control of the vacuum pressure in return conduit 14 serves another important purpose. By keeping the vacuum pressure in return conduit 14 as high as possible without vaporization, the temperature of the steam in radiator 10 is lowered causing the heating surface temperature of radiators 10 to be reduced. This reduces the energy used in the radiator and maintains a more comfortable room temperature by reducing extremes.

Referring again to FIG. 1, the elements not yet described in that figure have for their purpose to make sure that the plant is not subjected to such a risk of pumping steam and to reduce the energy used. For this reason, connected to return conduit 14 is a pressure measuring instrument 58 which measures the steam or water pressure from the input side of pump 40. A temperature measuring instrument 60 is also provided for measuring the temperature of the steam or water present in return conduit 14. It is contemplated that the two instruments 58 and 60 may be of the same type as the instruments 30 and 28, respectively, described above and therefore that instruments 58 and 60 are connected to a control unit 62 which may be of the same construction as control unit 18 shown in FIG. 2. Of course, the values of the resistors contained in control unit 18 may be different.

In a manner similar to control unit 18, control 62 is supplied with a voltage from a transformer 64 through a rectifier 66. Switch contact 68 of control unit 62 is arranged to cut off the current to starting relay 70 of pump 40 whenever instruments 58 and 60 indicate a risk that steam will appear in return conduit 14. The risk of steam includes not only the case where return conduit 14 contains only steam, but also the case where return conduit 14 contains a mixture of steam and water. Such conditions may exist where the vacuum created by pump 40 in the conduit leading to pump 40 is too strong.

The operation of control unit 62 serves to shut off pump 40 where there is a risk of steam being pumped so that the heat transfer medium is forced to remain in heat radiator 10 for a longer period of time. By remaining in heat radiators 10 for a longer period of time, the heat transfer medium is given a sufficient opportunity to condense completely so that no steam enters return conduit 14 or is created in conduit 14 due to the vacuum caused by pump 40. As soon as only condensed water is again moving through return conduit 14, this is indicated by instruments 58 and 60 so that pump 40 resumes its operation and the entire system is again in normal operation.

The operation of control unit 62 also serves to maintain the greatest possible vacuum pressure in return conduit 14. This automatically reduces the steam temperature and hence the heating surface temperature of radiators 10 to reduce the energy used and to maintain a more comfortable temperature in the room by reducing heating extremes. This occurs during operation of the heating system as follows. When thermostatic radiator control valve 13 closes due to room temperature being satisfied, the temperature of radiator 10 is reduced to a temperature related to the vacuum pressure in return line 14. As condensate collects in radiator 10 and steam trap 15 opens, the pressure in radiator 10 then is reduced to that existing in return line 14. By varying the vacuum pressure in return line 14 as a function of the temperature of the condensate to keep it below a value where saturation can occur, flashing or vaporization of the condensate from the steam trap is prevented.

The temperature of the condensate in return line 14 also gives an indication of the load on the heating system. For example, when the heating system starts up in the morning after a lowered night setback room temperature, the condensate in radiator 10 is at a high temperature so that the vacuum pressure in return line 14 is correspondingly lowered by controlling the operation of vacuum pump to prevent vaporization. As the heating system succeeds in warming up the rooms in the building, the condensate temperature begins to drop. Control unit 62 senses this drop in condensate temperature and automatically changes the operating range of vacuum pump 40 to increase the vacuum pressure in return line 14. This increased vacuum pressure effectively lowers the temperature of the steam in radiator 10. By way of example, at 620 mmHg vacuum, the steam temperature is 58° C.; at 515 mmHg vacuum, the steam temperature is 71° C.; at 370 mmHg vacuum, the steam temperature is 82° C.; and at 165 mmHg vacuum, the steam temperature is 93° C. Thus, less energy is used to heat the room at greater vacuum pressures and the heating surface of radiator 10 is lower at greater vacuum pressures. The lower the temperature of the radiator surface, the more comfortable the room is because extreme temperature differences between the radiator and the room are avoided.

Figure 4:
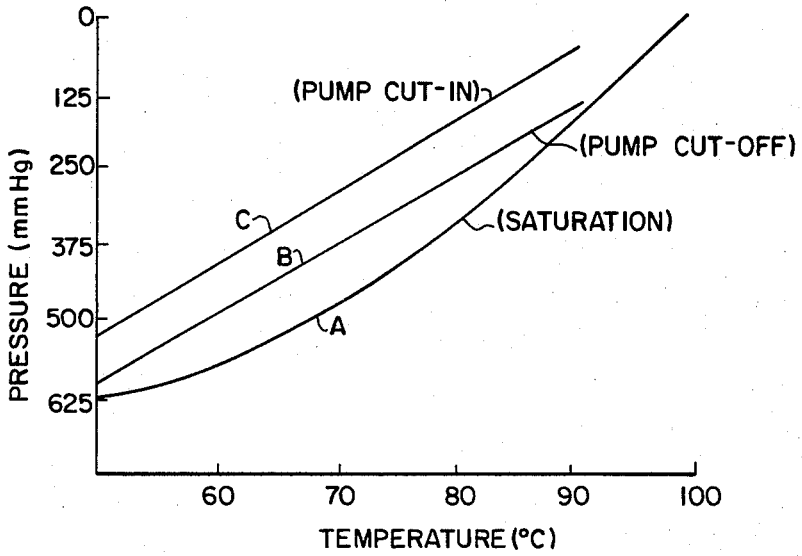
FIG. 4 is a temperature-gas pressure graph depicting the operation of the control unit provided in the return conduit.

The operation of control unit 62 is further explained with reference to FIG. 4. In FIG. 4, a graph is shown with the vacuum indicated by instrument 58 plotted in millimeters of mercury along the vertical axis and the temperature as measured by instrument 60 is plotted in °C. along the horizontal axis. This graph shows three curves A, B, and C.

Curve A shows the evaporation pressure for each specific temperature. Thus, at a temperature of 100° C., there should be a zero millimeters of mercury difference in pressure with respect to atmospheric pressure. As shown, the pressure must rapidly decrease with falling temperature. In order to reduce the risk of steam in return conduit 14, the pressure on the input side of pump 40 should be higher than that shown by curve A for each specific temperature. In this manner, the different components of control unit 62 have values so that pump 40 operates only when the temperature and pressure satisfies the above-mentioned condition.

As an example, in FIG. 4 a first curve B shows a suitable curve for the pressure/temperature relation for the input side of pump 40 so that vacuum pump 40 is shut-off when this curve is reached. On the other hand, curve C shows the corresponding relation which is reached after cut-off to cause vacuum pump 40 to be turned back on. Therefore, vacuum pump 40 operates in the range between curves B and C.

I claim:

1. A building heating system with a plurality of steam radiators comprising:

a steam boiler;

a feeder conduit connecting said boiler to the radiators;

a return conduit connecting the radiators to said boiler;

a vacuum pump disposed in said return conduit for pumping condensed water from the radiators to said boiler;

a temperature sensing means for generating a signal indicative of the actual temperature outside of the building;

a steam pressure sensing means for generating a signal indicative of the actual pressure in said feeder conduit; and a control unit, responsive to the signals generated by said temperature sensing means and said pressure sensing means, for providing an output signal in dependence upon a predetermined mutually dependent relationship between the outdoor temperature and feeder conduit pressure for shutting off said boiler when the pressure in said feeder conduit as sensed by said steam pressure sensing means exceeds a predetermined value determined by said predetermined relationship and corresponding to the specific actual temperature sensing means, and for starting said boiler when the pressure decreases to a value below the said predetermined value.

2. A heating system as claimed in claim 1 further including:

a vacuum pressure sensing means for generating a signal indicative of the actual vacuum in said return conduit at a location between said vacuum pump and the radiators;

a second temperature sensing means for generating a signal indicative of the actual temperature of the heat transfer medium in said return conduit; and a second control unit, responsive to the signals from said vacuum sensing means and said second temperature sensing means, for acting to shut off said vacuum pump when the mutual relationship between the vacuum and the temperature of the heating fluid in said return conduit is such that there is a risk of steam occurring in said return conduit, and for also acting to restart said vacuum pump when the risk has ceased.

3. A heating system as claimed in claims 1 or 2 wherein at least one of said control units comprises a Wheatstone bridge having at least four resistors, one of said resistors being a thermistor which is serving as a temperature sensing means and another of said resistors is variable in response to said pressure sensing means.

4. A heating system as claimed in claim 3 wherein said another of said resistors is mechanically connected for variation to said pressure sensing means.

5. A heating system as claimed in claim 4 wherein said pressure sensing means comprises an enclosed space which is variable as to volume and subjected to a resilient bias tension, a part of the periphery of said closed space being mechanically connected to said another of said resistors, and said another of said resistors is a potentiometer.

6. A heating system as claimed in claim 5 wherein said closed space is a bellows.

7. A building heating system with a plurality of steam radiators comprising:

a steam boiler;

a feeder conduit connecting said boiler to the radiators;

a return conduit connecting the radiators to said boiler;

a vacuum pump disposed in said return conduit for pumping condensed water from the radiators to said boiler;

a vacuum pressure sensing means for generating a signal indicative of the actual vacuum in said return conduit at a location between said vacuum pump and the radiators;

a temperature sensing means for generating a signal indicative of the actual temperature of the heat transfer medium in said return conduit; and a control unit, responsive to the signals from said vacuum sensing means and said temperature sensing means, for producing an output signal in dependence upon a mutual directly proportional relationship between the actual values of the vacuum and the temperature of the heat transfer medium in the return conduit for providing shut off of said vacuum pump when the mutual relationship between the actual values of the vacuum and the temperature of the heat transfer medium in said return conduit is such that there is a risk of steam occurring in said return conduit, and for also providing restarting of said vacuum pump when the risk has ceased.

* * * * *